US010840577B2

(12) United States Patent
Yuan et al.

(10) Patent No.: US 10,840,577 B2
(45) Date of Patent: Nov. 17, 2020

(54) RESONATOR AND COMMUNICATIONS APPARATUS

(71) Applicant: HUAWEI TECHNOLOGIES CO., LTD., Guangdong (CN)

(72) Inventors: Bengui Yuan, Shanghai (CN); Ling Guo, Shanghai (CN); Xiangyu Bao, Shenzhen (CN); Wenqi Ding, Shanghai (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/453,804

(22) Filed: Jun. 26, 2019

(65) Prior Publication Data

US 2019/0319331 A1 Oct. 17, 2019

Related U.S. Application Data

(63) Continuation of application No. PCT/CN2016/112384, filed on Dec. 27, 2016.

(51) Int. Cl.

| | |
|---|---|
| ***H01P 7/04*** | (2006.01) |
| ***H01P 7/10*** | (2006.01) |
| ***H01P 1/207*** | (2006.01) |
| *H01P 1/20* | (2006.01) |

(52) U.S. Cl.

CPC ..... *H01P 7/10* (2013.01); *H01P 1/207* (2013.01); *H01P 7/04* (2013.01); *H01P 1/2002* (2013.01)

(58) Field of Classification Search

CPC ..... H01P 7/04; H01P 7/06; H01P 7/00; H01P 1/208; H01P 1/2133; H01P 1/207

USPC ..... 333/219, 203, 206, 207, 202, 222, 223, 333/224, 225, 226, 235

See application file for complete search history.

(56) References Cited

U.S. PATENT DOCUMENTS

| | | | |
|---|---|---|---|
| 4,037,182 | A | 7/1977 | Burnett et al. |
| 6,114,928 | A | 9/2000 | Smith |
| 6,600,394 | B1 | 7/2003 | Wang et al. |
| 2006/0284708 | A1 | 12/2006 | Reeves |
| 2016/0294030 | A1 | 10/2016 | Kwak et al. |
| 2016/0315368 | A1 | 10/2016 | Liang et al. |

FOREIGN PATENT DOCUMENTS

| | | |
|---|---|---|
| CN | 101964437 | 2/2011 |
| CN | 201946724 U | 8/2011 |
| CN | 202167594 U | 3/2012 |
| CN | 102496765 A | 6/2012 |
| CN | 202308237 U | 7/2012 |

(Continued)

*Primary Examiner* — Stephen E. Jones

(74) *Attorney, Agent, or Firm* — Womble Bond Dickinson (US) LLP

(57) ABSTRACT

This application provides a resonator that includes a housing and a cover. A resonant rod, a dielectric block, and an elastic element are disposed in the housing. The resonant rod is in a tubular shape and includes an inner side face, an outer side face, and a first end face. The dielectric block includes a bottom end and a top end, the top end is connected to the cover, a second end face and a boss that protrudes from the second end face are disposed at the bottom end, and the boss is in an annular shape. The boss is embedded in the resonant rod a, or the boss fits around the outside of the resonant rod. The elastic element is connected between the first end face and the second end face or between the top end of the dielectric block and the cover.

20 Claims, 9 Drawing Sheets

(56) References Cited

FOREIGN PATENT DOCUMENTS

| | | | |
|---|---|---|---|
| CN | 203218421 | U | 9/2013 |
| CN | 204361232 | U | 5/2015 |
| CN | 104852118 | A | 8/2015 |
| CN | 105529512 | A | 4/2016 |
| CN | 205488212 | U | 8/2016 |
| EP | 0065785 | A1 | 12/1982 |
| JP | S5399849 | A | 8/1978 |
| KR | 20160136783 | A | 11/2016 |
| WO | 2015100541 | A1 | 7/2015 |

RESONATOR AND COMMUNICATIONS APPARATUS

CROSS-REFERENCE TO RELATED APPLICATIONS

This application is a continuation of International Application No. PCT/CN2016/112384, filed on Dec. 27, 2016, the disclosure of which is hereby incorporated by reference in its entirety.

TECHNICAL FIELD

This application relates to the field of communications technologies, and in particular, to a resonator.

BACKGROUND

With fast development of wireless communications, a resonator acts as a key module in a wireless communications system, and has become a trend due to its features of miniaturization, high power, and a high quality factor (Q value).

In the prior art, a resonant rod and a dielectric material are disposed in a cavity resonator, and the dielectric material is installed between a cover and the resonant rod. A tuning screw passes through the cover and couples the cover to the dielectric material and the resonant rod, to implement tuning of the resonator.

With regard to structures of all components of a resonator and an assembly relationship between all the components, how to improve miniaturization of the resonator, achieve easy assembly and disassembly of the resonator, and improve reliability remains a direction of research in the industry.

SUMMARY

Embodiments of this application provide a resonator, so as to implement miniaturization, easy assembly, and easy disassembly, and improve performance reliability of the resonator.

According to a first aspect, a resonator is provided and includes a housing and a cover, where an accommodating cavity is disposed in the housing, a resonant rod, a dielectric block, and an elastic element are disposed in the accommodating cavity, and the cover is assembled on the housing; the resonant rod is in a tubular shape and includes an inner side face, an outer side face, and a first end face that is connected between the inner side face and the outer side face; the dielectric block includes a bottom end and a top end, the top end is connected to the cover, a second end face and a boss that protrudes from the second end face are disposed at the bottom end, and the boss is in an annular shape; the first end face is opposite to the second end face; the boss is embedded in the resonant rod and surrounded by the inner side face, or the boss fits around the outside of the resonant rod and surrounds the outer side face; and the elastic element is connected between the first end face and the second end face and/or between the top end of the dielectric block and the cover, and the elastic element is electrically conductive.

In one embodiment, the boss is disposed at the bottom end of the dielectric block, and the boss fits around or is embedded in the resonant rod in a coordinated manner, so as to position the dielectric block on the resonance rod. Then, the elastic element is connected between the first end face and the second end face and/or between the top end of the dielectric block and the cover, so as to implement a close connection between the resonant rod, the dielectric block, and the cover. The boss fits around or is embedded in the resonant rod in a coordinated manner, so that the resonator provided in this application is easily positioned and installed in an assembly process, and the dielectric block and the resonant rod partly overlap in a radial direction, which is helpful to a miniaturization design of the resonator. In addition, the resonator provided in this application is reliable, and has a higher unloaded Q value and higher passive intermodulation performance compared with a conventional medium loading technology.

In one embodiment, the boss is located on a periphery of the second end face, and the boss includes an outer surface and an inner surface that are opposite to each other, and a third end face that is connected between the outer surface and the inner surface; the dielectric block includes a columnar body, the second end face is a bottom surface of the columnar body, and a top surface of the columnar body faces the cover; and the outer surface of the boss is co-planar with a side face of the columnar body, and the inner surface of the boss faces the outer side face of the resonant rod. In one embodiment, the boss fits around the resonant rod, and the outer surface of the boss is co-planar with the side face of the columnar body, so that the outer surface of the dielectric block is smooth without an obvious step. This facilitates uniform current transmission, increases an unloaded Q value, and improves passive intermodulation performance.

In one embodiment, the second end face is in contact with the first end face, the inner surface of the boss is in contact with the outer side face of the resonant rod, and the elastic element is disposed between the top end of the dielectric block and the cover. In one embodiment, the elastic element is disposed between the cover and the dielectric block, and the dielectric block is in close contact with the resonant rod. In one embodiment, the elastic element may be fastened to the cover first, which helps to position the dielectric block on a top surface of the resonant rod through coordination of the boss and the resonant rod, and then the cover is pressed to the top end of the dielectric block. This assembly manner is simple and convenient, and saves time.

In one embodiment, the elastic element includes a spacing part and an elastic part, where the spacing part is in an annular shape, and the elastic part bends and extends from the spacing part towards a center of the spacing part; and the spacing part fits around a periphery of the resonant rod, the spacing part is located between the inner surface of the boss and the outer side face of the resonant rod, and the elastic part is connected between the second end face and the first end face. In one embodiment, the elastic element is disposed between the dielectric block and the resonant rod, and a nested structure is formed between the elastic element, the dielectric block, and the resonant rod: The elastic element fits around a top of the resonant rod, and the boss part of the dielectric block fits around the outside of the elastic element. This is convenient for installation and positioning.

In one embodiment, at least one opening groove is disposed on the elastic part, and an elastic contact structure is formed on the elastic part through disposing of the opening groove, where the elastic contact structure abuts between the second end face and the first end face.

In one embodiment, the boss is located on an inner edge of the second end face, and the boss includes an outer surface and an inner surface that are opposite to each other, and a third end face that is connected between the outer surface and the inner surface; the dielectric block includes a columnar body, and a central through-hole is disposed in the columnar body; and the inner surface of the boss is co-planar with an inner wall of the central through-hole, and the outer surface of the boss faces the inner side face of the resonant rod. In one embodiment, the boss is embedded in the resonant rod, and the inner surface of the boss is co-planar with the inner wall of the central through-hole of the dielectric block, so that the inner surface of the dielectric block is smooth without an obvious step. This facilitates uniform current transmission, increases an unloaded Q value, and improves passive intermodulation performance.

In one embodiment, the second end face is in contact with the first end face, the outer surface of the boss is in contact with the inner side face of the resonant rod, and the elastic element is disposed between the top end of the dielectric block and the cover.

In one embodiment, the elastic element includes a spacing part and an elastic part, where the spacing part is in an annular shape, and the elastic part bends and extends from the spacing part towards a direction away from a center of the spacing part; and the spacing part is embedded inside the resonant rod, the spacing part is located between the outer surface of the boss and the inner side face of the resonant rod, and the elastic part is connected between the second end face and the first end face. In one embodiment, the boss is embedded in the resonant rod, and a stacking and embedded structure is formed between the boss and the resonant rod by using the elastic element. To be specific, the spacing part of the elastic element is embedded inside the resonant rod, and the boss is embedded inside the spacing part of the elastic element. This is convenient for installation and positioning.

In one embodiment, at least one opening groove is disposed on the elastic part, and an elastic contact structure is formed on the elastic part through disposing of the opening groove, where the elastic contact structure abuts between the second end face and the first end face.

In one embodiment, the cover is an elastic cover. The elastic cover continuously and uniformly presses against the dielectric block, so that a close contact is formed between the dielectric block and the resonant rod.

In one embodiment, the bottom end and the top end of the dielectric block are coated with a conductive coating.

In one embodiment, a dielectric constant of a material of the dielectric block is greater than 1.

In one embodiment, the elastic element is in an integrated structure.

In one embodiment, the resonant rod and the housing are integrated, and the housing includes a bottom wall, where the bottom wall faces the cover, and the resonant rod vertically extends from the bottom wall towards the cover.

In one embodiment, the resonant rod and the housing are separate structures.

According to a second aspect, this application further provides a communications apparatus, where the communications apparatus includes at least one resonator according to any one of the foregoing implementations. The communications apparatus may be a filter, a duplexer, a multiplexer, or another communications device.

BRIEF DESCRIPTION OF DRAWINGS

The following briefly describes the accompanying drawings required for describing the embodiments.

DESCRIPTION OF EMBODIMENTS

The following describes the embodiments of this application with reference to accompanying drawings.

Figure 1:
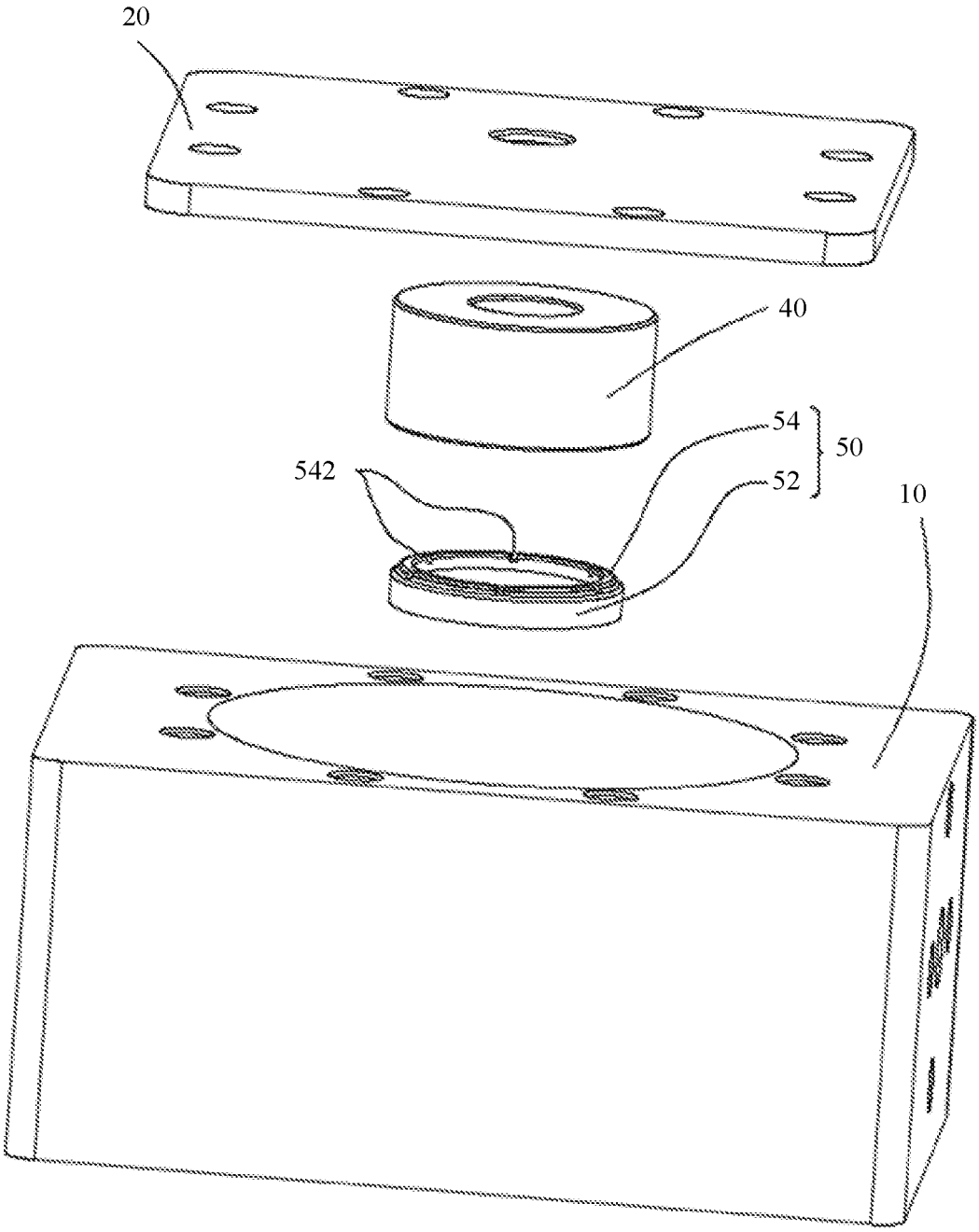
FIG. 1 is a three-dimensional schematic exploded view of a resonator according to an implementation of this application.
Figure 2:
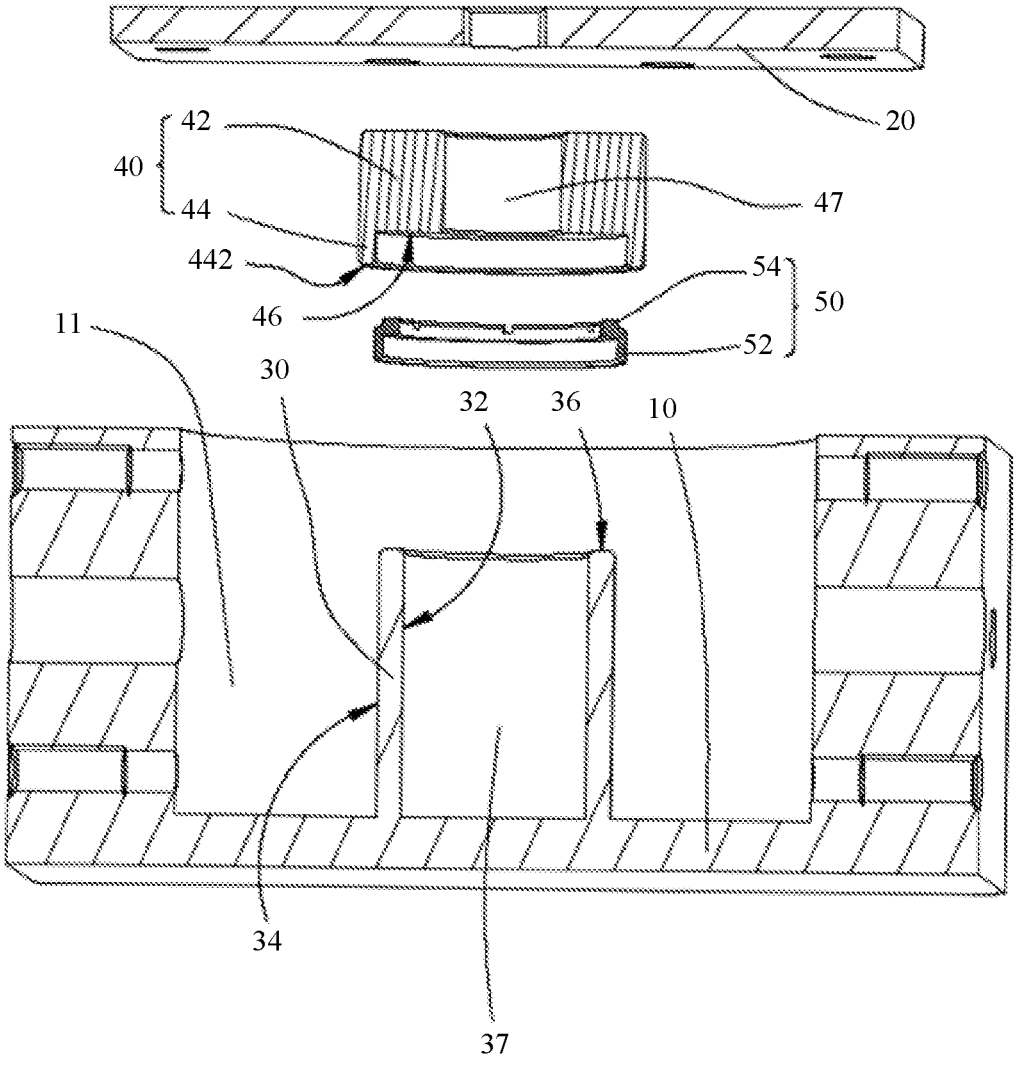
FIG. 2 is a sectional schematic exploded view of the resonator shown in FIG. 1.
Figure 3:
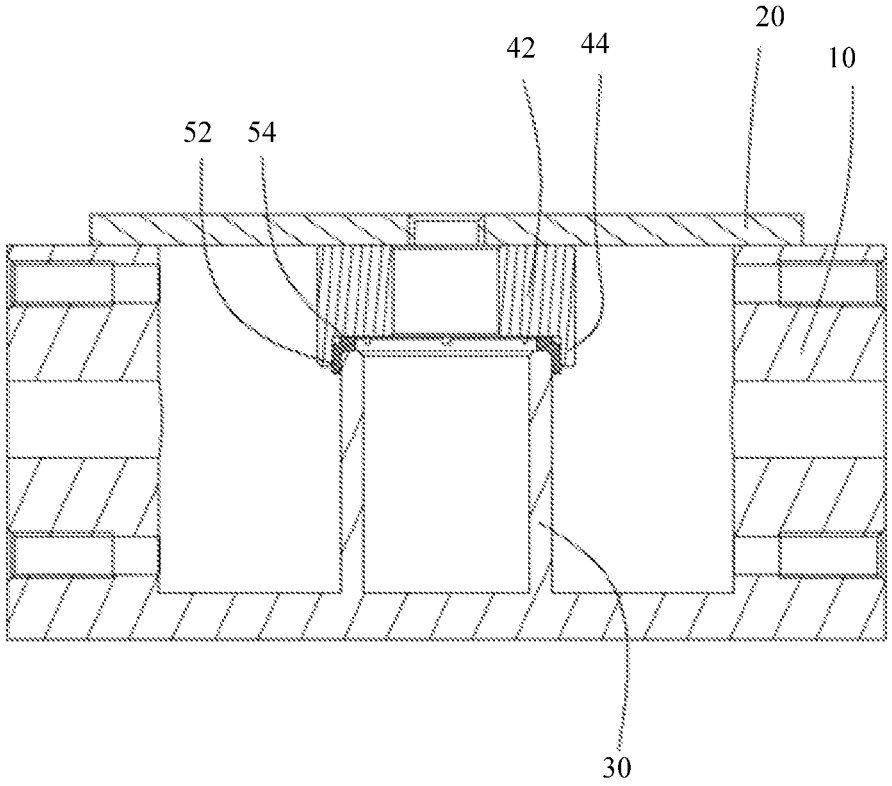
FIG. 3 is a sectional schematic assembly diagram of the resonator shown in FIG. 1.
Figure 4:
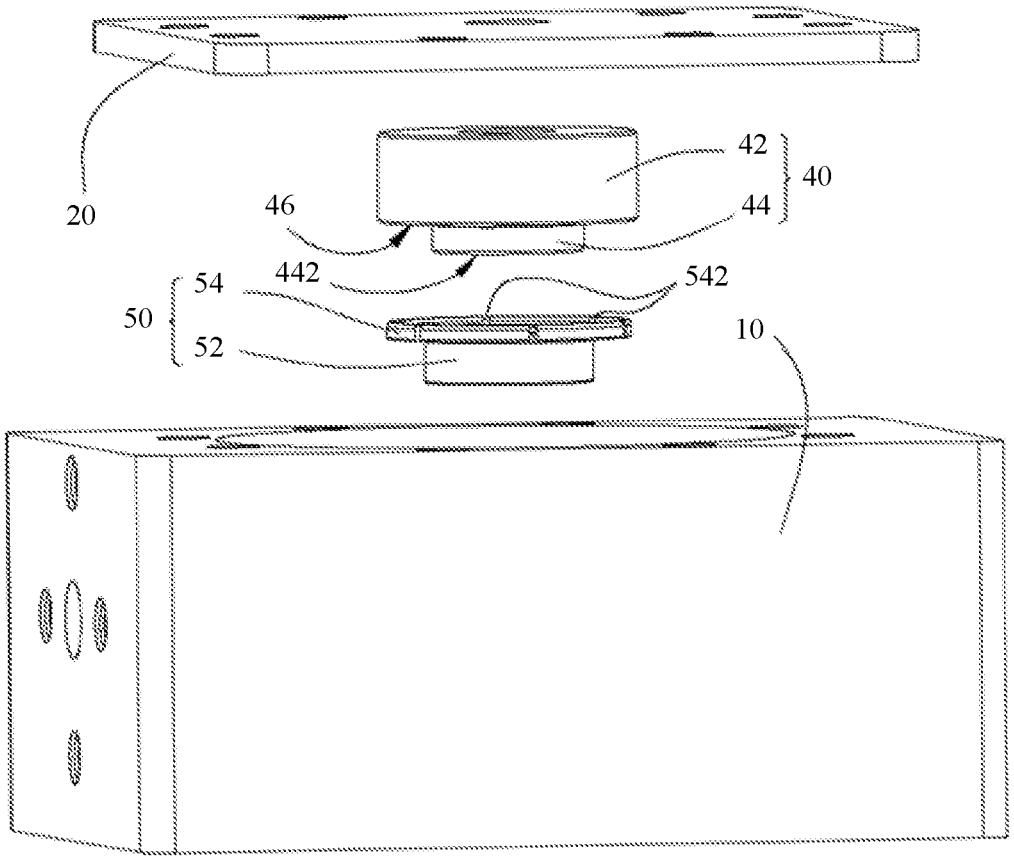
FIG. 4 is a three-dimensional schematic exploded view of a resonator according to another implementation of this application.
Figure 5:
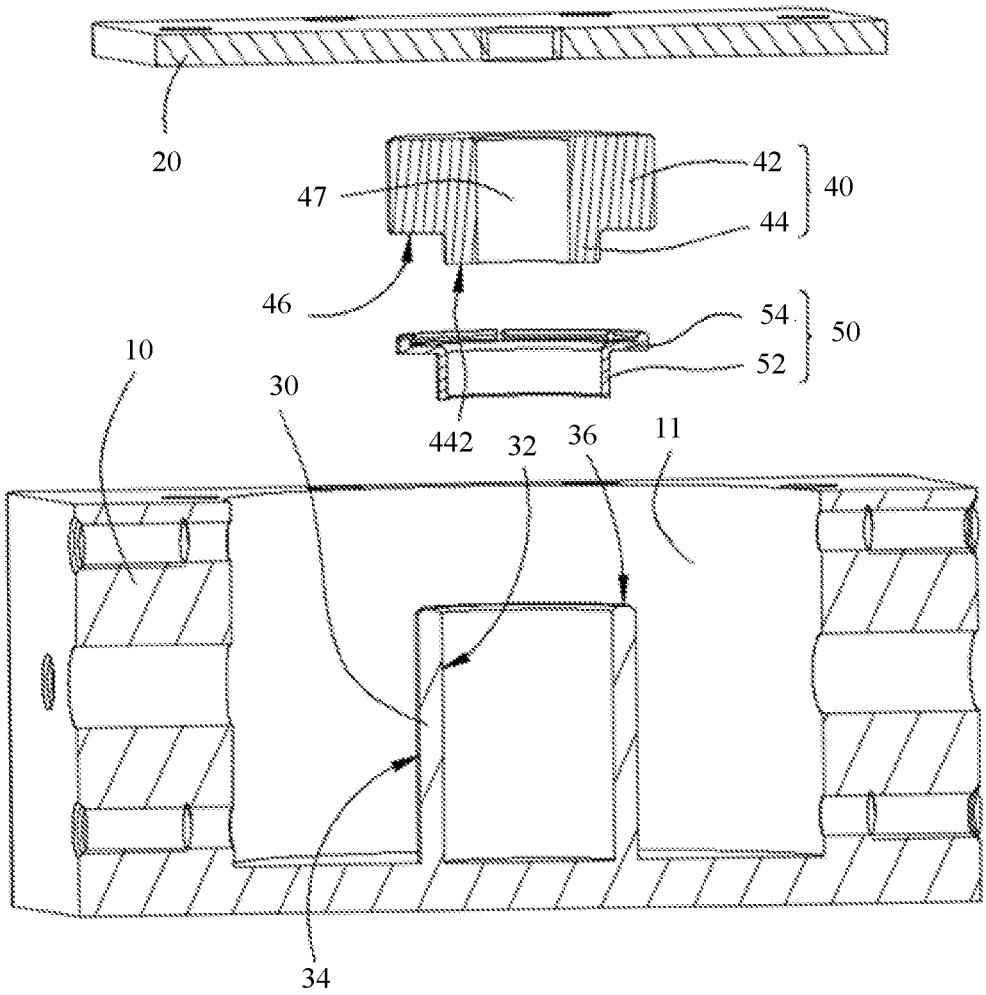
FIG. 5 is a sectional schematic exploded view of the resonator shown in FIG. 4.
Figure 6:
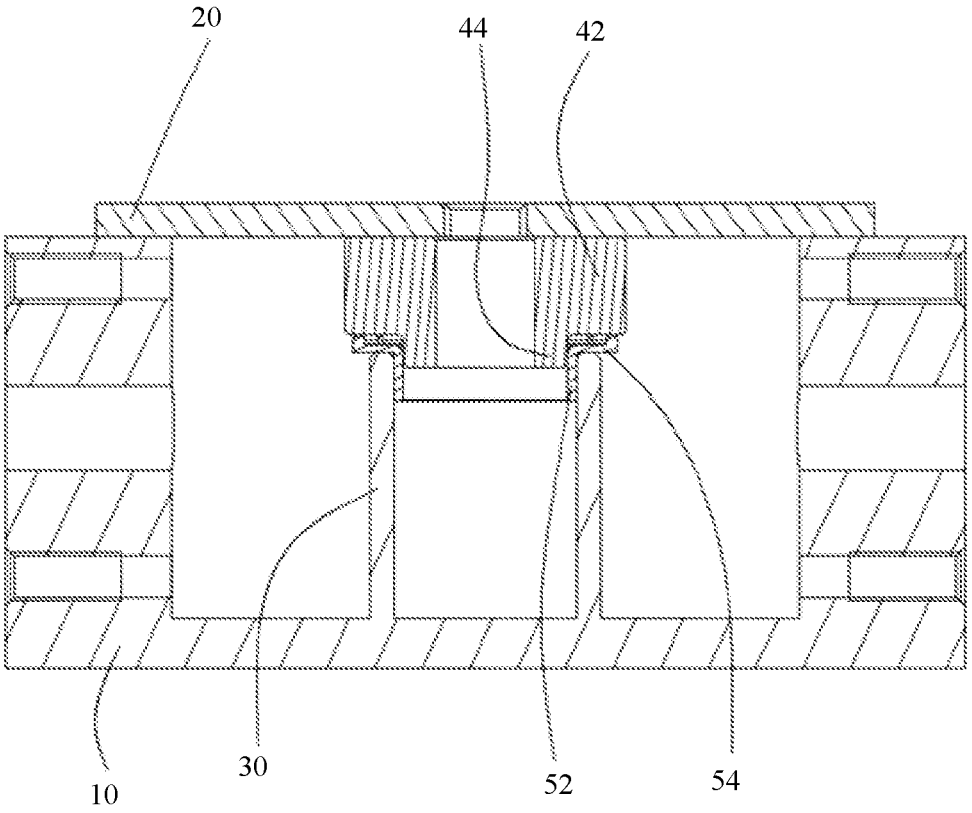
FIG. 6 is a sectional schematic assembly diagram of the resonator shown in FIG. 4.

This application provides a resonator and a communications apparatus that includes the resonator. The communications apparatus in this application may be a filter, a duplexer, a multiplexer, or another communications device. FIG. 1 to FIG. 3 are schematic diagrams of a resonator according to an implementation of this application. FIG. 4 to FIG. 6 are schematic diagrams of a resonator according to another implementation of this application. A difference between the two implementations lies in a connection structure between a dielectric block, an elastic element, and a resonant rod that are inside the resonator. The following first describes the resonator according to the embodiments shown in FIG. 1 to FIG. 3.

Referring to FIG. 1, FIG. 2, and FIG. 3, the resonator includes a housing 10 and a cover 20. An accommodating cavity 11 is disposed in the housing 10, a resonant rod 30, a dielectric block 40, and an elastic element 50 are disposed in the accommodating cavity 11. The cover 20 is assembled on the housing 10. The dielectric block 40 and the elastic element 50 are installed on and pressed against the resonant rod 30 by using the cover 20. In other words, the dielectric block 40 and the elastic element 50 are connected between the resonant rod 30 and the cover 20. The elastic element 50 has conductive performance. In one embodiment, the elastic element 50 is made of a conductive material, and may be a metal spring plate. In another implementation, a surface of the elastic element 50 is covered with a conductive material, and a conductive layer is wrapped on an outer surface of a non-conductive material to implement electrical conductivity. In one embodiment, the resonator may further include a tuning screw (not shown in the figures). The tuning screw passes through the cover 20, reaches into the dielectric block 40 and/or the resonant rod 30, and is configured to tune the resonator.

In one embodiment, the housing 10 is a metal cavity structure, the housing 10 may be entirely a metal material or include a cavity with at least an inner surface metalized, and the accommodating cavity 11 in the housing 10 is a resonant cavity. The housing 10 includes a bottom wall and an opening end, and the bottom wall faces the opening end. The resonant rod 30 is disposed on the bottom wall. The cover 20 covers the opening end and is fastened to the housing 10.

The cover 20 may be an independent board (which functions merely as a cover board). In another implementation, the cover 20 may be a printed circuit board (PCB), that is, functions of a cover board and the PCB board are integrated, so that the cover board also has a PCB function of carrying an electronic element, and when the PCB board is installed on and fastened to the housing 10 and covers the opening end, the PCB board is used as the cover 20.

The dielectric block 40 is disposed in a capacitance area inside the accommodating cavity 11. In one embodiment, the capacitance area is an area between the resonant rod 30 and the cover 20. The capacitance area has relatively strong electric intensity, and the area between the resonant rod 30 and the cover 20 is an area with the strongest electric intensity. A dielectric constant εr of the dielectric block 40 is greater than 1. Breakdown field strength of the dielectric block 40 is usually several times or even dozens of times higher than that of air, and therefore, a power capacity of the resonator provided in this application is significantly increased due to configuration of the dielectric block 40.

In one embodiment, a quality factor Qf of a dielectric material of the dielectric block 40 is greater than 1000, to reduce dielectric loss. Generally, a Qf being 1000 is a boundary that decides whether the dielectric material is plastic or ceramic. The quality factor is a reciprocal of the dielectric loss of the dielectric material. In one embodiment, a material of the dielectric block 40 is ceramic, single-crystal quartz, or aluminum oxide.

The resonant rod 30 is in a tubular shape and includes an inner side face 32, an outer side face 34, and a first end face 36 that is connected between the inner side face 32 and the outer side face 34. The first end face 36 is located at a side of the resonant rod 30 that is away from the bottom wall and faces the cover 20. In one embodiment, the resonant rod 30 is in a round tubular shape, and a columnar channel 37 is disposed inside.

The dielectric block 40 includes a bottom end and a top end, where the top end is connected to the cover 20, a second end face 46 and a boss 44 that protrudes from the second end face 46 are disposed at the bottom end, and the boss 44 is in an annular shape. In one embodiment, the whole dielectric block 40 is in a cylindrical shape and includes a central through-hole 47, a section of the central through-hole 47 in a radial direction is in a round shape or another shape, and the central through-hole 47 interconnects the channel 37 of the resonant rod 30 with a through-hole on the cover 20 that is used for the tuning screw to pass through. The channel 37 of the resonant rod 30, the central through-hole 47 of the dielectric block 40, and the through-hole on the cover 20 may share a same central line. The first end face 36 is opposite to the second end face 46. In another implementation, no central through-hole may be disposed on the dielectric block 40, that is, the dielectric block 40 is a solid structure. In this case, no through-hole is required to be disposed on the cover 20 for the tuning screw to pass through.

In one embodiment, the boss 44 fits around the outside of the resonant rod 30 and surrounds the outer side face 34. In the embodiment shown in FIG. 4 to FIG. 6, the boss 44 is embedded in the resonant rod 30 and surrounded by the inner side face 32. Coordination structures between the dielectric block 40 and the resonant rod 30, provided in the two implementations, shall both fall within the protection scope of this application.

In one embodiment, the elastic element 50 is connected between the first end face 36 and the second end face 46. The elastic element 50 may be an annular elastic sheet. An elastic force is generated when the elastic element 50 is deformed under a force, so that the dielectric block 40 and the resonant rod 30 are tightly press-fitted, and the dielectric block 40 and the cover 20 are tightly press-fitted, thereby effectively improving an anti-interference capability and electrical performance of the resonator.

In one embodiment, the boss 44 is located on a periphery of the second end face 46, and the boss 44 includes an outer surface and an inner surface that are opposite to each other, and a third end face 442 that is connected between the outer surface and the inner surface. The dielectric block 40 includes a columnar body 42, the second end face 46 is a bottom surface of the columnar body 42, and a top surface of the columnar body 42 faces the cover 20. The outer surface of the boss 44 is co-planar with a side face of the columnar body 42, and the inner surface of the boss 44 faces the outer side face 34 of the resonant rod 30. In one embodiment, the boss 44 fits around the resonant rod 30, and the outer surface of the boss 44 is co-planar with the side face of the columnar body 42, so that the outer surface of the dielectric block 40 is smooth without an obvious step. This facilitates uniform current transmission, increases an unloaded Q value, and improves passive intermodulation performance.

Figure 7:
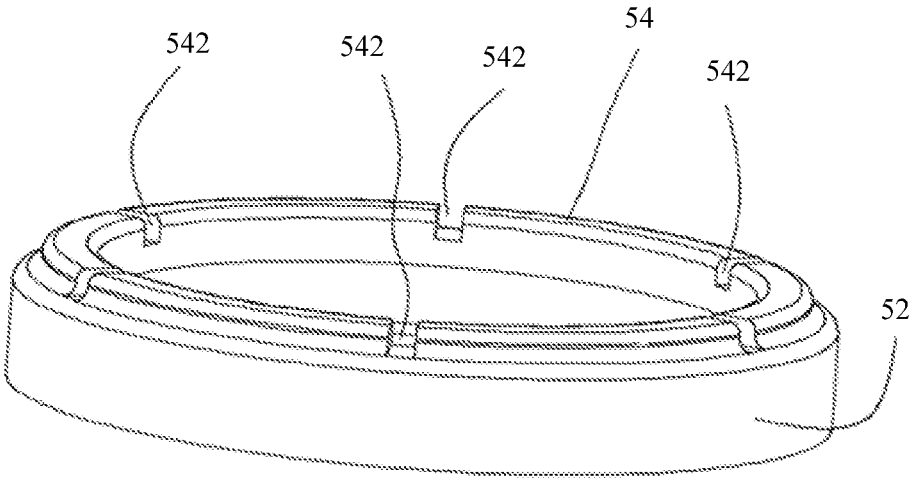
FIG. 7 is an enlarged schematic diagram of an elastic element of the resonator shown in FIG. 1.

Referring to FIG. 7, the elastic element 50 includes a spacing part 52 and an elastic part 54, the spacing part 52 is in an annular shape, and the elastic part 54 bends and extends from the spacing part 52 towards a center of the spacing part 52. The spacing part 52 fits around a periphery of the resonant rod 30, the spacing part 52 is located between the inner surface of the boss 44 and the outer side face 34 of the resonant rod 30, and the elastic part 54 is connected between the second end face 46 and the first end face 36. In one embodiment, the elastic element 50 is disposed between the dielectric block 40 and the resonant rod 30, and a nested structure, in one embodiment, a radial stacking structure, is formed between the elastic element 50, the dielectric block 40, and the resonant rod 30: The elastic element 50 fits around a top of the resonant rod 30, and the boss part 44 of the dielectric block 40 fits around the outside of the elastic element 50. This is convenient for installation and positioning.

In one embodiment, an opening groove 542 is disposed on the elastic part 54, and there may be one, two, or more opening grooves 542. A plurality of opening grooves 542 are distributed around a circumference, an elastic contact structure is formed between adjacent opening grooves 542, and the elastic contact structure abuts between the second end face 46 and the first end face 36.

In another implementation, the elastic element 50 may alternatively be connected between the top end of the dielectric block 40 and the cover 20. When the elastic element 50 is disposed between the dielectric block 40 and the cover 20, a structure form of the elastic element may be different from that of the foregoing elastic element 50, and a regular elastic sheet or a metal spring plate (a shape is not limited, provided that the dielectric block 40 and the cover 20 can be in elastically contact) may be selected and disposed between the dielectric block 40 and the cover 20. The elastic element may be fastened to a side of the cover 20, or may be fastened to a side of the dielectric block 40, and a specific manner of fastening may be to fasten by using a screw, or to attach and fasten by using an adhesive, or the like. The dielectric block 40 may be directly in contact with the resonant rod 30. The second end face 46 is in contact with the first end face 36, and the inner surface of the boss 44 is in contact with the outer side face 34 of the resonant rod 30. In one embodiment, the elastic element 50 is disposed between the cover 20 and the dielectric block 40, and the dielectric block 40 is in close contact with the resonant rod 30. In one embodiment, the elastic element 50 may be fastened to the cover 20 first, the dielectric block 40 is positioned on a top surface of the resonant rod 30 through coordination of the boss 44 and the resonant rod 30, and then the cover 20 is pressed to the top end of the dielectric block 40. This assembly manner is simple and convenient, and saves time.

Referring to FIG. 4, FIG. 5, and FIG. 6, in one embodiment, the boss 44 is embedded in the resonant rod 30 and surrounded by the inner side face 32. The boss 44 is located on an inner edge of the second end face 46, and the boss 44 includes an outer surface and an inner surface that are opposite to each other, and a third end face 442 that is connected between the outer surface and the inner surface. The dielectric block 40 includes a columnar body 42, a central through-hole 47 is disposed in the columnar body 42, the inner surface of the boss 44 is co-planar with an inner wall of the central through-hole 47, and the outer surface of the boss 44 faces the inner side face 32 of the resonant rod 30. In one embodiment, the boss 44 is embedded in the resonant rod 30, and the inner surface of the boss 44 is co-planar with the inner wall of the central through-hole 47 of the dielectric block 40, so that the inner surface of the dielectric block 40 is smooth without an obvious step. This facilitates uniform current transmission, increases an unloaded Q value, and improves passive intermodulation performance. In another implementation, no central through-hole may be disposed on the dielectric block 40, that is, the dielectric block 40 is a solid structure. In this case, the boss 44 is also a solid structure and includes an outer surface and a third end face, and no through-hole is required to be disposed on the cover 20 for the tuning screw to pass through.

Figure 8:
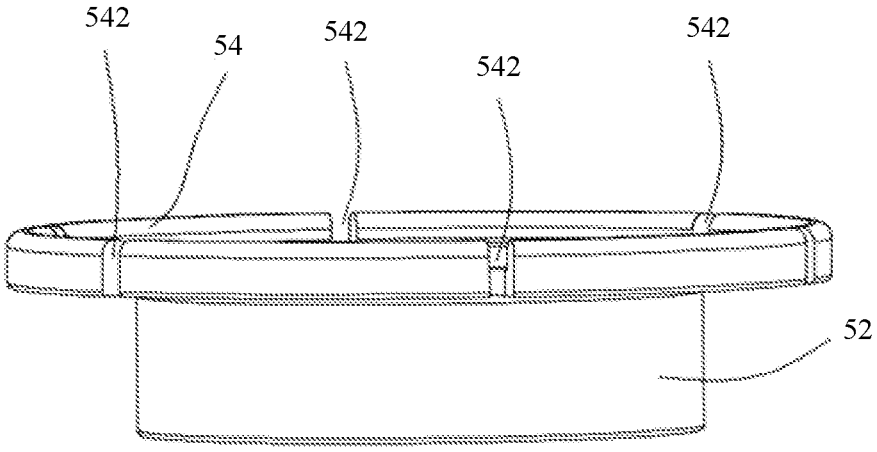
FIG. 8 is an enlarged schematic diagram of an elastic element of the resonator shown in FIG. 4.

Referring to FIG. 8, in one embodiment, the elastic element 50 includes an annular spacing part 52 and an elastic part 54, and the elastic part 54 bends and extends from the spacing part 52 towards a direction away from a center of the spacing part 52. The spacing part 52 is embedded inside the resonant rod 30, the spacing part 52 is located between the outer surface of the boss 44 and the inner side face 32 of the resonant rod 30, and the elastic part 54 is connected between the second end face 46 and the first end face 36. In one embodiment, a stacking and embedded structure is formed between the boss 44 and the resonant rod 30 by using the elastic element 50. To be specific, the spacing part 52 of the elastic element 50 is embedded inside the resonant rod 30, and the boss 44 is embedded inside the spacing part 52 of the elastic element 50. This is convenient for installation and positioning.

In one embodiment, an opening groove 542 is disposed on the elastic part 54, and there may be one, two, or more opening grooves 542. A plurality of opening grooves 542 are distributed around a circumference, an elastic contact structure is formed between adjacent opening grooves 542, and the elastic contact structure abuts between the second end face 46 and the first end face 36. The opening groove 542 is disposed to form the elastic contact structure.

In another implementation, the elastic element 50 may alternatively be connected between the top end of the dielectric block 40 and the cover 20, and the dielectric block 40 is in direct contact with the resonant rod 30. The second end face 46 is in contact with the first end face 36, and the outer surface of the boss 44 is in contact with the inner side face 32 of the resonant rod 30.

With reference to the foregoing different implementations, the cover 20 may be an elastic cover, an elastic part is disposed on a position where the cover 20 and the dielectric block 40 are in contact, and the elastic part is used to generate an elastic pressing force in a direction vertical to the cover 20. The elastic cover 20 continuously and uniformly presses against the dielectric block 40, so that a close contact is formed between the dielectric block 40 and the resonant rod 30.

The elastic element 50 may be disposed between the dielectric block 40 and the resonant rod 30, or may be disposed between the dielectric block 40 and the cover 20; alternatively, the elastic element may be disposed between the dielectric block 40 and the resonant rod 30, and between the dielectric block 40 and the cover 20. Regardless of where the elastic element 50 is disposed, the elastic cover can be used. Because a function of the elastic cover is to press-fit the dielectric block 40 to the resonant rod 30, pressure is more balanced. And a function of the elastic element 50 is to implement a close connection between the dielectric block 40 and the resonant rod 30. Connections of the two elastic elements are independent and do not affect each other. Moreover, no matter where the elastic element 50 is disposed, a structure and a shape of the elastic element 50 are not limited to the structures described in this application, and may alternatively be another structure and shape, provided that an elastic connection effect can be implemented between the first end face 36 and the second end face 46.

In one embodiment, the bottom end and the top end of the dielectric block 40 are coated with a conductive coating. A function of the conductive coating is to implement a path for electromagnetic transmission, so that electromagnetic waves are transmitted along a surface of the bottom end and that of the top end, and do not go deep into the dielectric block 40. This can reduce attenuation of electromagnetic transmission. In an optional embodiment, the conductive coating is metal, for example, silver or copper.

In one embodiment, the elastic element 50 is in an integrated structure. The elastic element 50 is integrated by using processes such as stamping and machining. In one embodiment, a material of the elastic element 50 is beryllium copper, and the beryllium copper is a material that has a good deformation capability and can recover.

In one embodiment of this application, the resonant rod 30 and the housing 10 are integrated, and the housing 10 includes a bottom wall, where the bottom wall faces the cover 20, and the resonant rod 30 vertically extends from the bottom wall towards the cover 20. In one embodiment, an integrated rounding design may be used for a joint position between a bottom of the resonant rod 30 and the bottom wall, to avoid a sharp corner. This can reduce generation of a no-linear area, and improve passive intermodulation performance. An integrated structure of the resonant rod 30 and the housing 10 may be formed by machining or die-casting in the housing 10, and the resonant rod inside the housing 10 may be in a tapered triangle shape, or may be in a form of transition steps, or the like.

In one embodiment, the resonant rod 30 and the housing 10 are separate structures, and the resonant rod 30 may be fastened to the housing 10 by using a screw, or be connected to the housing 10 by welding.

In one embodiment, the boss 44 is disposed at the bottom end of the dielectric block 40, and the boss 44 fits around or is embedded in the resonant rod 30 in a coordinated manner, so as to position the dielectric block 40 on the resonant rod 30. In an assembly process, this assembly positioning manner allows the dielectric block 40 to be reliably positioned and easily disassembled. Then, the elastic element 50 is connected between the first end face 36 and the second end face 46 or between the top end of the dielectric block 40 and the cover 20, so as to implement a close connection between the resonant rod 30, the dielectric block 40, and the cover 20. The boss 44 fits around or is embedded in the resonant rod 30 in a coordinated manner, so that the resonator provided in this application is easily positioned and installed in an assembly process, and the dielectric block 40 and the resonant rod 30 partly overlap in a radial direction, which is helpful to a miniaturization design of the resonator. In addition, the resonator provided in this application is reliable, and has a higher unloaded Q value and improves passive intermodulation performance compared with a conventional medium loading technology. This application is applicable to a resonator with a large power capacity, which has good temperature drift performance and intermodulation performance.

In one embodiment, the dielectric block 40 and the resonant rod 30 together form a resonant structure in a cavity of the resonator. Based on an operating frequency requirement, a height ratio of the dielectric block 40 and the resonant rod 30 may be properly allocated, and the height is a distance vertical to the cover 20. Through adjustment of the height ratio, a volume of the resonator can be reduced to meet a requirement of miniaturization.

Figure 9:
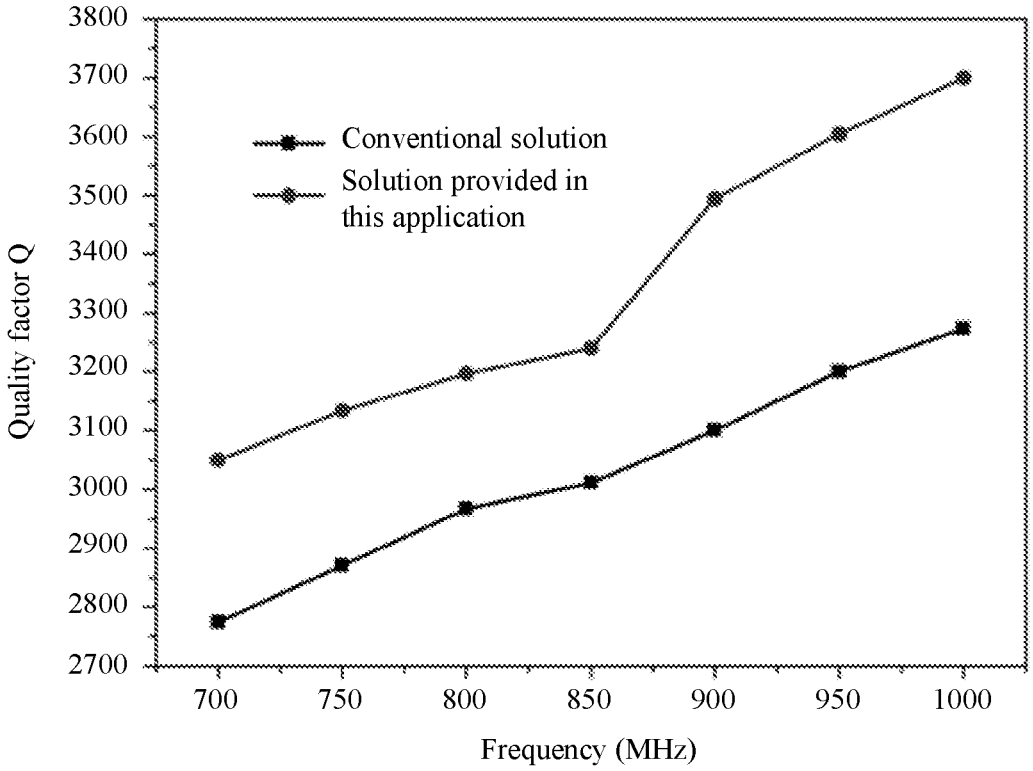
FIG. 9 shows a comparison between Q values of a resonator provided in one embodiment of this application and a conventional resonator in a same volume.

FIG. 9 shows a comparison between Q values of a resonator provided in one embodiment of this application and a conventional resonator in a same volume. It can be seen that, compared with a conventional technology, this application can lower frequency and maintain a relatively high Q value and power in a smaller volume. Because a radial stacking structure is disposed at the position where the dielectric block 40 and the resonant rod 30 are in contact, no step impedance is introduced to affect the Q value, and the greatest Q value is maintained.

Figure 10:
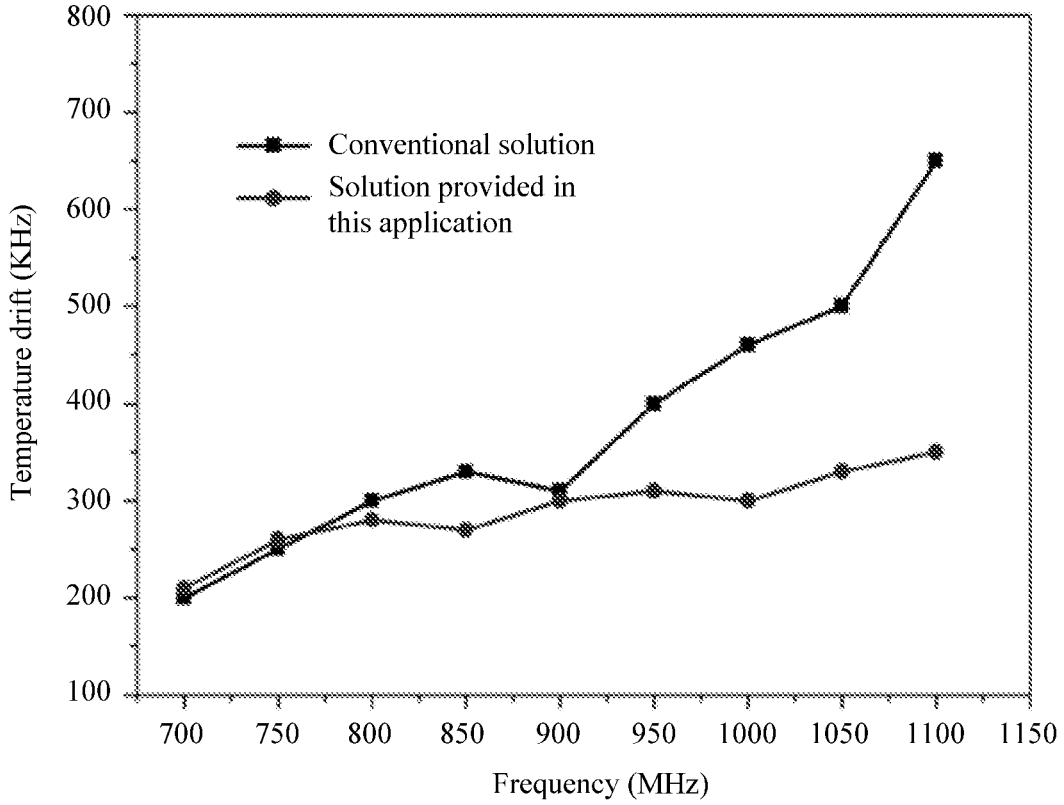
FIG. 10 shows a comparison between temperature compensations of a resonator provided in one embodiment of this application and a conventional resonator in a same volume.

FIG. 10 shows a comparison between temperature compensations of a resonator provided in one embodiment of this application and a conventional resonator in a same volume. The resonator in this application has a relatively small temperature drift capacity. In a conventional medium loading technology, both a coefficient of expansion of the dielectric block and that of the resonant rod 30 need to be adjusted, so that the resonator has a desirable temperature drift range. This is relatively difficult. In this application, the resonant rod 30 and the cavity may be integrated, and therefore, the coefficients of expansion are the same, and only a temperature coefficient of a medium needs to be optimized, and a relatively small temperature drift feature is implemented.

In the resonator provided in this application, the dielectric material may alternatively be added in another area with relatively strong electric intensity, for example, an area between the resonant rod 30 and an inner wall of the housing 10.

Finally, it should be noted that the foregoing embodiments are merely intended for describing the technical solutions of this application, but not for limiting this application. Although this application is described in detail with reference to the foregoing embodiments, a person of ordinary skill in the art should understand that the descriptions are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A resonator comprising a housing and a cover, wherein an accommodating cavity is disposed in the housing, a resonant rod, a dielectric block, and an elastic element are disposed in the accommodating cavity, and the cover is assembled on the housing; the resonant rod is in a tubular shape and comprises an inner side face, an outer side face, and a first end face that is connected between the inner side face and the outer side face; the dielectric block comprises a bottom end and a top end, the top end is connected to the cover, a second end face and a boss that protrudes from the second end face are disposed at the bottom end, and the boss is in an annular shape; the first end face is opposite to the second end face; the boss is embedded in the resonant rod and surrounded by the inner side face, or the boss fits around the outside of the resonant rod and surrounds the outer side face; and the elastic element is connected between the first end face and the second end face or between the top end of the dielectric block and the cover, and the elastic element is electrically conductive.

2. The resonator according to claim 1, wherein the boss is located on a periphery of the second end face, and the boss comprises an outer surface and an inner surface that are opposite to each other, and a third end face that is connected between the outer surface and the inner surface; the dielectric block comprises a columnar body, the second end face is a bottom surface of the columnar body, and a top surface of the columnar body faces the cover; and the outer surface of the boss is co-planar with a side face of the columnar body, and the inner surface of the boss faces the outer side face of the resonant rod.

3. The resonator according to claim 2, wherein the second end face is in contact with the first end face, the inner surface of the boss is in contact with the outer side face of the resonant rod, and the elastic element is disposed between the top end of the dielectric block and the cover.

4. The resonator according to claim 2, wherein the elastic element comprises a spacing part and an elastic part, wherein the spacing part is in an annular shape, and the elastic part bends and extends from the spacing part towards a center of the spacing part; and the spacing part fits around a periphery of the resonant rod, the spacing part is located between the inner surface of the boss and the outer side face of the resonant rod, and the elastic part is connected between the second end face and the first end face.

5. The resonator according to claim 4, wherein at least one opening groove is disposed on the elastic part, and an elastic contact structure is formed on the elastic part through disposing of the opening groove, wherein the elastic contact structure abuts between the second end face and the first end face.

6. The resonator according to claim 1, wherein the boss is located on an inner edge of the second end face, and the boss comprises an outer surface and an inner surface that are opposite to each other, and a third end face that is connected between the outer surface and the inner surface; the dielectric block comprises a columnar body, and a central through-hole is disposed in the columnar body; and the inner surface of the boss is co-planar with an inner wall of the central through-hole, and the outer surface of the boss faces the inner side face of the resonant rod.

7. The resonator according to claim 6, wherein the second end face is in contact with the first end face, the outer surface of the boss is in contact with the inner side face of the resonant rod, and the elastic element is disposed between the top end of the dielectric block and the cover.

8. The resonator according to claim 6, wherein the elastic element comprises a spacing part and an elastic part, wherein the spacing part is in an annular shape, and the elastic part bends and extends from the spacing part towards a direction away from a center of the spacing part; and the spacing part is embedded inside the resonant rod, the spacing part is located between the outer surface of the boss and the inner side face of the resonant rod, and the elastic part is connected between the second end face and the first end face.

9. The resonator according to claim 8, wherein at least one opening groove is disposed on the elastic part, and an elastic contact structure is formed on the elastic part through disposing of the opening groove, wherein the elastic contact structure abuts between the second end face and the first end face.

10. The resonator according to claim 1, wherein the bottom end and the top end of the dielectric block are coated with a conductive coating.

11. The resonator according to claim 1, wherein a dielectric constant of a material of the dielectric block is greater than 1.

12. The resonator according to claim 1, wherein the elastic element is in an integrated structure.

13. The resonator according to claim 1, wherein the resonant rod and the housing are integrated, and the housing comprises a bottom wall, wherein the bottom wall faces the cover, and the resonant rod vertically extends from the bottom wall towards the cover.

14. The resonator according to claim 1, wherein the resonant rod and the cover are separate structures.

15. A communications apparatus comprising:

at least one resonator;

the at least one resonator including:

a housing and a cover, wherein an accommodating cavity is disposed in the housing, a resonant rod, a dielectric block, and an elastic element are disposed in the accommodating cavity, and the cover is assembled on the housing; the resonant rod is in a tubular shape and comprises an inner side face, an outer side face, and a first end face that is connected between the inner side face and the outer side face; the dielectric block comprises a bottom end and a top end, the top end is connected to the cover, a second end face and a boss that protrudes from the second end face are disposed at the bottom end, and the boss is in an annular shape; the first end face is opposite to the second end face; the boss is embedded in the resonant rod and surrounded by the inner side face, or the boss fits around the outside of the resonant rod and surrounds the outer side face; and the elastic element is connected between the first end face and the second end face or between the top end of the dielectric block and the cover, and the elastic element is electrically conductive.

16. The apparatus according to claim 15, wherein the boss is located on a periphery of the second end face, and the boss comprises an outer surface and an inner surface that are opposite to each other, and a third end face that is connected between the outer surface and the inner surface; the dielectric block comprises a columnar body, the second end face is a bottom surface of the columnar body, and a top surface of the columnar body faces the cover; and the outer surface of the boss is co-planar with a side face of the columnar body, and the inner surface of the boss faces the outer side face of the resonant rod.

17. The apparatus according to claim 16, wherein the second end face is in contact with the first end face, the inner surface of the boss is in contact with the outer side face of the resonant rod, and the elastic element is disposed between the top end of the dielectric block and the cover.

18. The apparatus according to claim 16, wherein the elastic element comprises a spacing part and an elastic part, wherein the spacing part is in an annular shape, and the elastic part bends and extends from the spacing part towards a center of the spacing part; and the spacing part fits around a periphery of the resonant rod, the spacing part is located between the inner surface of the boss and the outer side face of the resonant rod, and the elastic part is connected between the second end face and the first end face.

19. The apparatus according to claim 18, wherein at least one opening groove is disposed on the elastic part, and an elastic contact structure is formed on the elastic part through disposing of the opening groove, wherein the elastic contact structure abuts between the second end face and the first end face.

20. The apparatus according to claim 15, wherein the boss is located on an inner edge of the second end face, and the boss comprises an outer surface and an inner surface that are opposite to each other, and a third end face that is connected between the outer surface and the inner surface; the dielectric block comprises a columnar body, and a central through-hole is disposed in the columnar body; and the inner surface of the boss is co-planar with an inner wall of the central through-hole, and the outer surface of the boss faces the inner side face of the resonant rod.

* * * * *